US006798154B1

(12) United States Patent
Sullivan et al.

(10) Patent No.: US 6,798,154 B1
(45) Date of Patent: Sep. 28, 2004

(54) DIGITAL POOL LIGHT

(76) Inventors: Challen Sullivan, 4798 Valencia Dr., Delray Beach, FL (US) 33445; Kevin Doyle, 4798 Valencia Dr., Delray Beach, FL (US) 33445; Bruce Johnson, 6296 NW. 63rd Way, Parkland, FL (US) 33067

( * ) Notice: Subject to any disclaimer, the term of this patent is extended or adjusted under 35 U.S.C. 154(b) by 338 days.

(21) Appl. No.: 10/091,899

(22) Filed: Mar. 6, 2002

Related U.S. Application Data

(60) Provisional application No. 60/324,358, filed on Sep. 24, 2001.

(51) Int. Cl.[7] ..... H05B 37/00

(52) U.S. Cl. ..... 315/362; 315/312; 315/158; 315/185 R

(58) Field of Search ..... 315/154–158, 315/185 R, 189, 193; 362/362, 800, 243, 244

(56) References Cited

U.S. PATENT DOCUMENTS 6,002,216 A * 12/1999 Mateescu ..... 315/363
6,184,628 B1 * 2/2001 Ruthenberg ..... 315/185 R
6,398,397 B1 * 6/2002 Koren ..... 362/562

* cited by examiner

*Primary Examiner*—James Vannucci
*Assistant Examiner*—Jimmy Vu
(74) *Attorney, Agent, or Firm*—Frank A. Lukasik

(57) ABSTRACT

The instant invention is a programmable, multi-colored, digital pool light system capable of operating multiple light sources and varying the power provided to each light bulb providing virtually unlimited amounts of light intensity, color blending and saturation. The light bulbs are mounted in a heat absorbing plate and light dispersing dichroic lenses are mounted above selected light bulbs. The program is operated by the ON/OFF switch.

2 Claims, 5 Drawing Sheets

DIGITAL POOL LIGHT

RELATED APPLICATIONS

This application is a Continuation of Provisional Patent Application Ser. No. 60/324,358, filed Sep. 24, 2001.

BACKGROUND OF THE INVENTION

1. Field of the Invention

The invention relates generally to pool lights and more specifically to a programmable, multi-colored underwater light.

2. Background of the Invention

A wide variety of lighting systems have been designed for use in controlling the color and intensity of lights in various applications. U.S. Pat. No. 4,317,071 to Murad discloses a computerized illumination system consisting mainly of two major subsystems, three colored lamps, and a solid state digital computer. The device was designed to have a switch arrangement to select one of a limited number of illumination "programs". The lamps are designed to illuminate the lamps in a fixed sequence, based on one of the lamps being a master to synchronize the other lamps. The rotational speed is either a fixed value or zero. This programming is done at the time of manufacture, after which it is either fixed or zero. The number of steps before a repeat of the pattern is limited to the number of light channels. The number of light channels is designed to be three, red, blue, and green. With these light colors operating in a "scattering medium", it claims to be able to produce the complete range of colors by raising or lowering the intensity of each channel. Although the reference claims mention that the blended color can be blended, this programming is done at the time of manufacture, after which it is fixed.

U.S. Pat. No. 5,041,767 to Droftei discloses a digital control for gas discharge tubes. The gas discharge tube is controlled in intensity and in the length along such tube that is illuminated by providing digital control signals to an analog drive circuit connected to the high-voltage energization device for the tube.

U.S. Pat. No. 5,406,176 to Sugden discloses a computer controlled stage lighting system having a plurality of multiple parameter lamp units each comprising means for producing a light beam having a plurality of adjustable parameters relating to beam characteristics and beam position.

U.S. Pat. No. 5,629,587 to Gray et al. discloses a programmable lighting control system for controlling illumination systems.

U.S. Pat. No. 6,031,343 to Recknagel et al. discloses a bowling center lighting system having a plurality of independently controlled light modules, each emitting light in response to an activation signal uniquely associated with the light module.

The instant invention is able to mimic the prior art in all ways and in addition distinguishes itself by incorporating the features summarized below.

SUMMARY OF THE INVENTION

The instant invention provides a programmable multi-colored underwater light comprised of a housing, multiple high intensity light bulb sources, a light dispersing lens, a water tight sealing mechanism, an electronic package including a programmable microprocesor and an electrical cord which can be wired into any 12 volt or higher power source. The size of the light is designed around the swimming pool industry standard underwater light niche and can be as large as 10 inches in diameter down to less than 3 inches in diameter. This light can be used in any underwater application including a swimming pool, SPA or fountain. Other sizes can also be produced depending on the application, but it should be noted that the swimming pool underwater light niche is currently installed in literally millions of existing installations. It is a key aspect of this light design that this product has the capability of retrofitting into most existing underwater light niches and can be UL approved to fully operate with any of the standard underwater light power sources including 12 volt AC and 120 volt AC.

DETAILED DESCRIPTION OF THE PREFERRED EMBODIMENT

Figure 1:
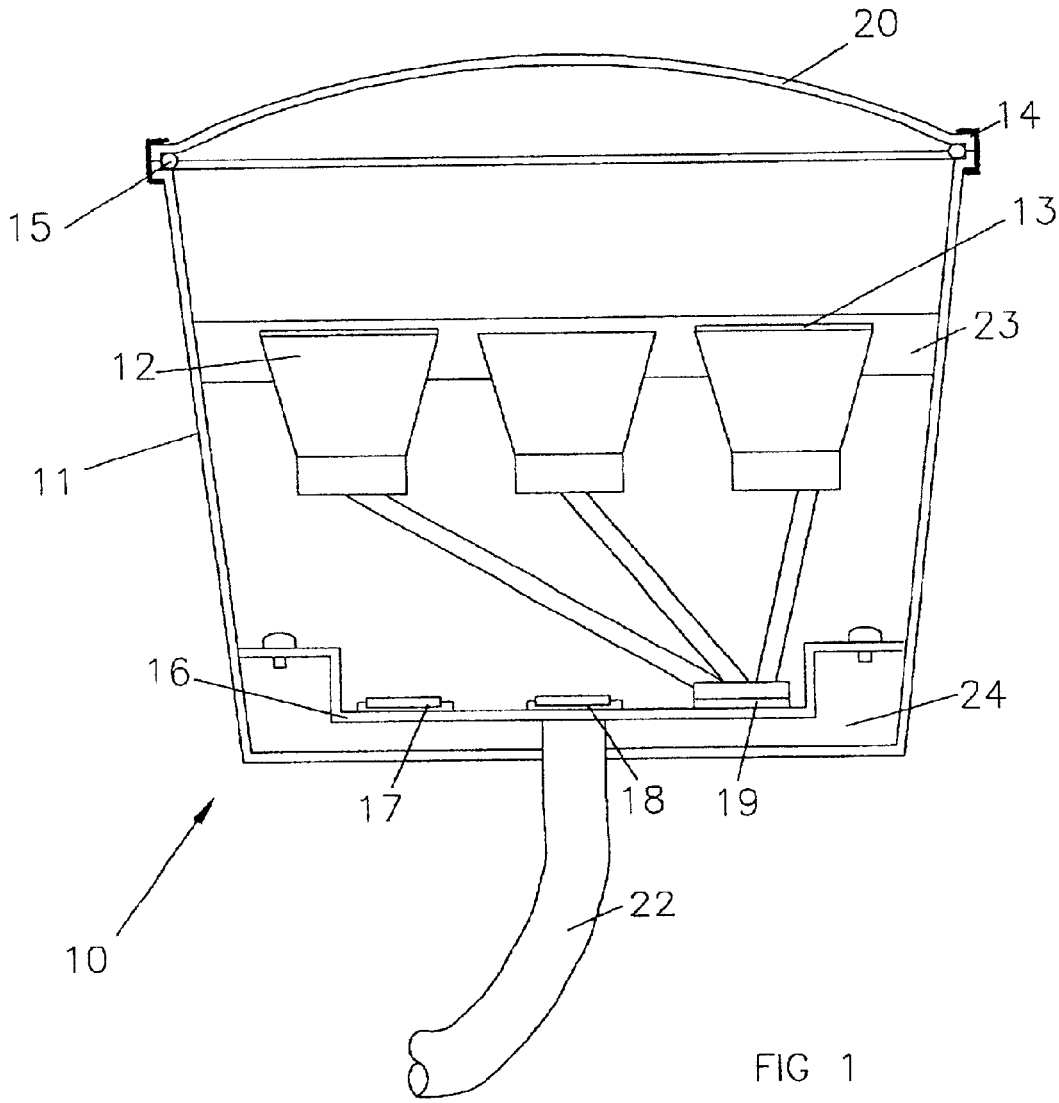
FIG. 1 is a side view, partially in section, of a digital pool light in accordance with the invention.

Referring now to the drawings wherein like numerals designate like and corresponding parts throughout the several views, in FIG. 1 the digital pool light 10 is shown in a side view. The digital pool light 10 of the invention comprises a housing 11, multiple, high intensity light bulb sources 12, a light dispersing dichroic lens 13, a mounting plate 23, a water tight sealing mechanism consisting of glass lens 20, a sealing clamp 14 and a rubber seal 15 fastened to housing 11 at the top rim 21. PC board 16 is mounted with transistors 17, microprocessor 18, connector 19, and a three wire power cord 22. The PC board may be secured to the housing with potting material 24.

Figure 2:
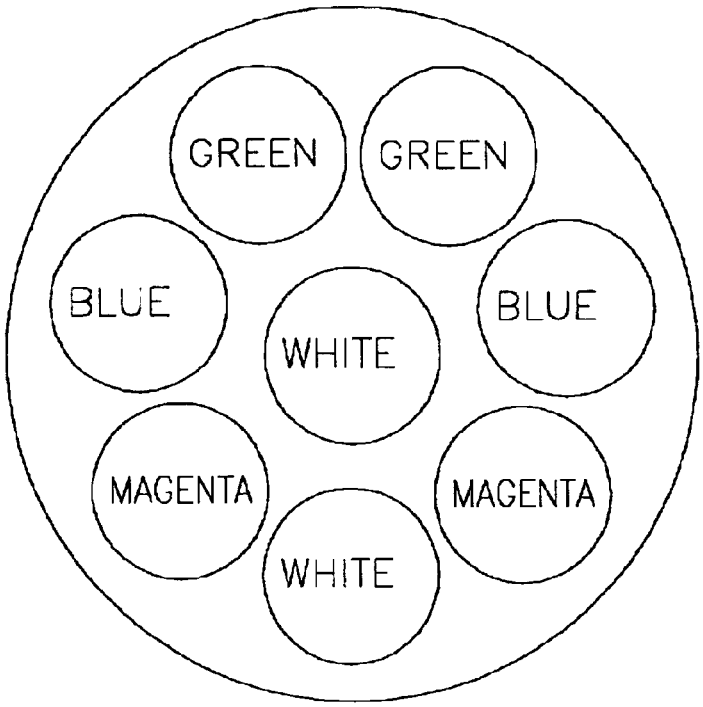
FIG. 2 is a top schematic view of a standard eight bulb layout in accordance with the invention.
Figure 3:
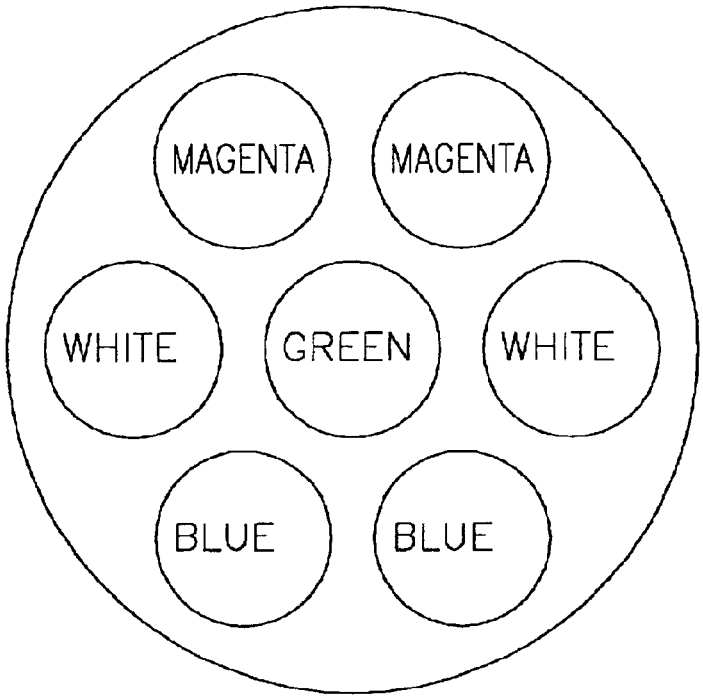
FIG. 3 is a top schematic view of a standard seven light layout in accordance with the invention.
Figure 4:
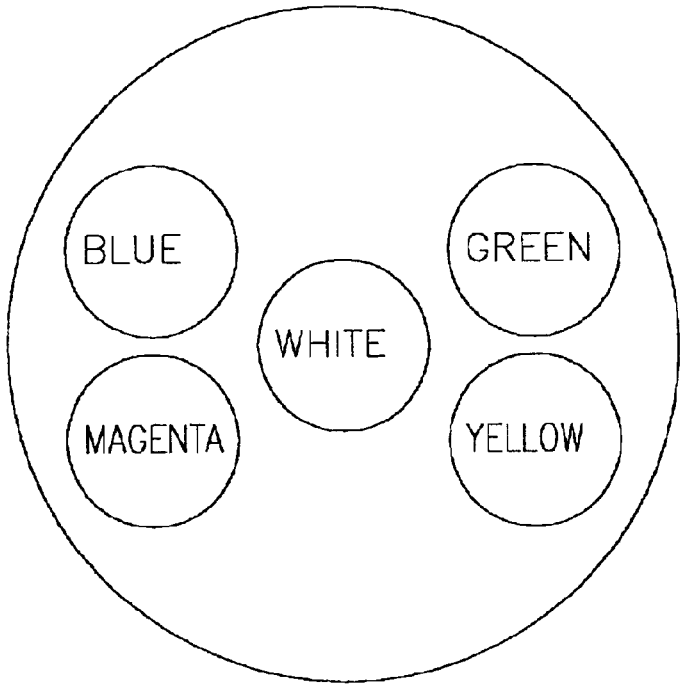
FIG. 4 is a top schematic view of a standard five light layout in accordance with the invention.
Figure 5:
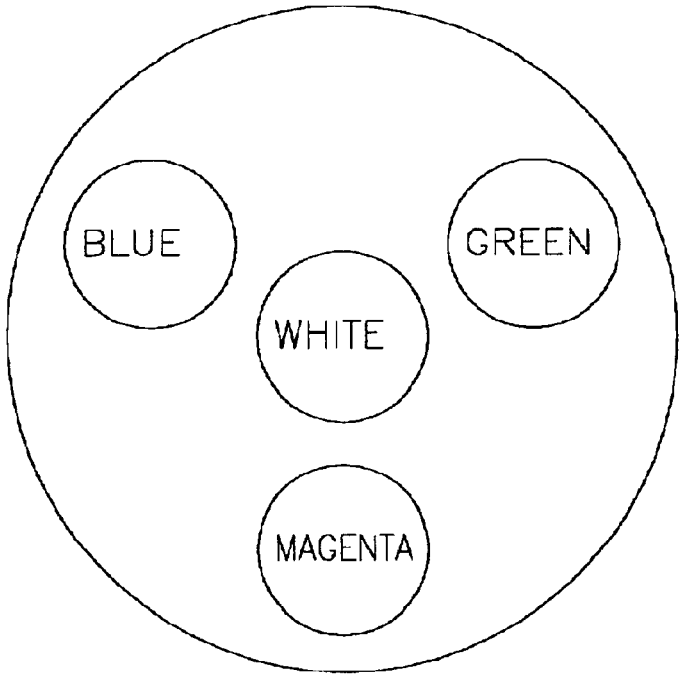
FIG. 5 is a top schematic view of a standard three light layout in accordance with the invention.
Figure 6:
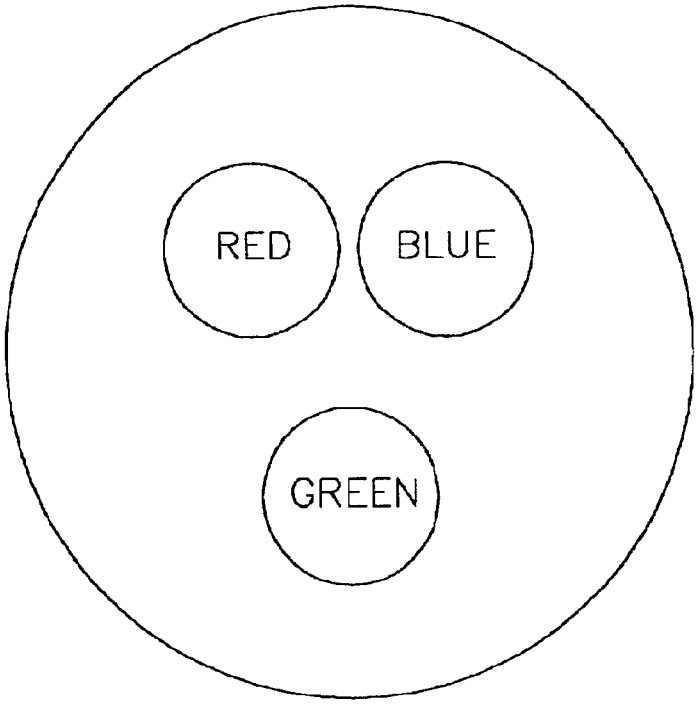
FIG. 6 is a top schematic view of a standard three light layout in accordance with the invention
Figure 7:
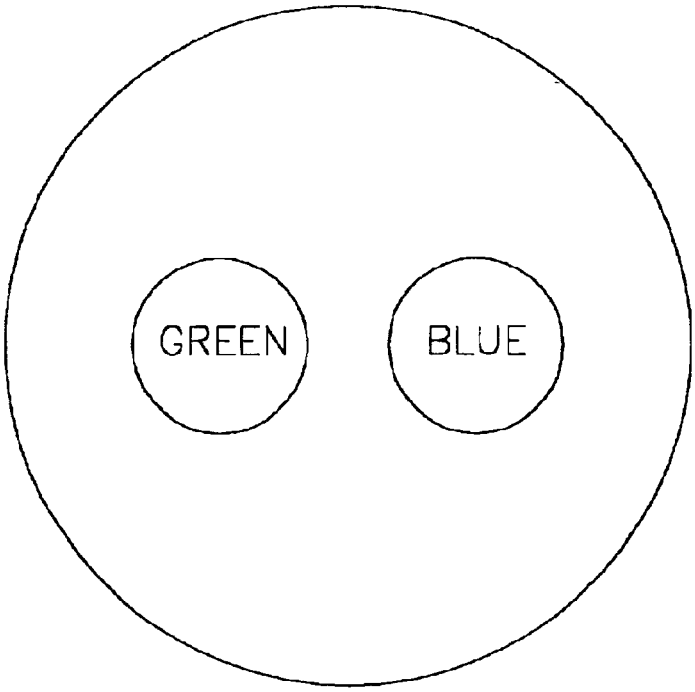
FIG. 7 is a top schematic view of a standard two light layout in accordance with the invention.
Figure 8:
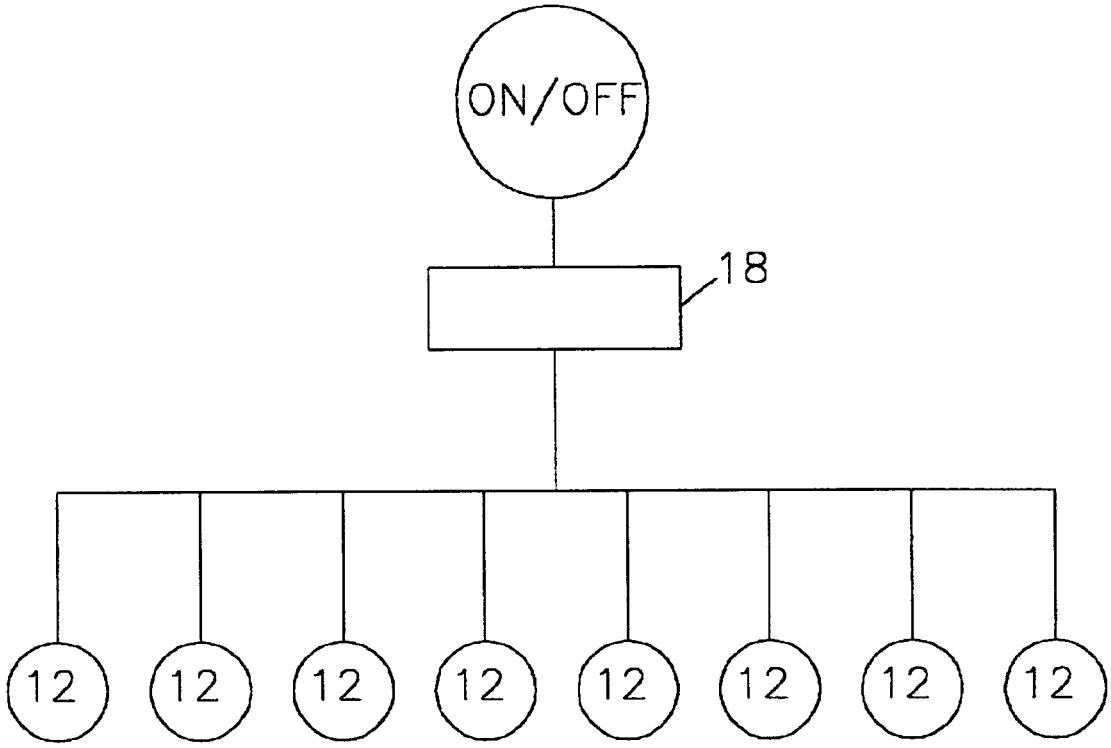
FIG. 8 illustrates the process planning of the PC board.

A bulb mounting plate 23 (heat sink) is fastened to the housing 11. The bulb mounting plate 23 is shown in FIGS. 2–7 in the various configurations according to the number of lights 12 to be used in the application. The bulb mounting plate 23 is shown in the figures with two to eight lights. FIG. 2 shows two green, two blue, two white, and two magenta lights 12, for example.

The instant invention successfully addresses the issue of providing a powerful light source capable of effectively lighting an average swimming pool, SPA or fountain with multiple color lighting options controlled by a programmable microprocessor 18. The invention uses a multi-light bulb source, lights 12, two lights or more, all housed within the limited size of a standard underwater light fixture. This design is unique in that its multi-bulb design provides a superior light output over standard lights as one or more light sources can be operated at the same time. In addition to operating multiple light sources, the programmable microprocessor 18 can vary the power provided to each light bulb thereby providing virtually unlimited amounts of light intensity, color blending and saturation. This programmable microprocessor 18 and corresponding circuitry is different from other attempts as other devices have used discreet electronic components which were not programmable. With the microprocessor 18, the programmer has complete and flexible control over all functions, which can provide much greater variety and options not possible with older technology.

Colors are produced by attaching specially built dichroic colored lens filters 13 over some of the light bulbs 12. These dichroic lenses 13 are extremely efficient, however, they are heat sensitive. Another key aspect of this invention is that the design allows multiple lower wattage bulbs to be used to create less heat, but superior light output. By combining different intensities of colors, a rainbow of color options are available. In addition, due to the programmable microprocessor 18 and corresponding electronic circuitry, no mechanical switches, relays or color wheels are required to switch between the individual light bulb sources, and virtually unlimited light and color options are available with this invention.

The preferred embodiment is limited to eight lights 12 due partially to the size of the standard pool light niche as well as the light intensity output requirement for underwater pool lights, and current bulb technology. As bulbs reduce in size and increase in light output the configuration can be changed to accommodate additional bulbs and/or additional colors may be added. The current light design uses two bulbs for each of the following four colors, white, magenta, green and blue. Many other color options are also available. By varying the number of bulbs that are operated, as well as varying the power to each bulb, the color spectrum can be dramatically changed. Other than LED technology, which cannot at this time produce the proper light intensity, the instant invention is the only light on the market which can effectively blend different primary colors into a rainbow of color output.

Other unique features include a "soft start" thermal shock protection for all of the lights 12. This effectively extends bulb life by a significant margin, a key to the overall operating efficiency of the system. Also, because the lights 12 are alternately turned on and off and because of the redundancy of the bulbs, the overall light fixture life is greatly enhanced. An enhancement designed into this fixture is the bulb mounting plate 23 which is a diecast metal plate that has been designed to channel excess heat generated by the high intensity bulbs from inside the fixture to the outer case, thereby significantly reducing the temperature inside the unit. Heat can have a detrimental effect to both the bulbs and the watertight seals used with this type of light.

Because of soft start feature, excellent heat sink technology through the mounting plate 23 and the redundancy of bulbs, this light fixture at the current time provides the longest bulb operating time possible, based on current bulb and light intensity requirements, on the market today.

Another feature of this invention is that it can be programmed with virtually an unlimited number of different lighting scripts. This allows the programmer the option of changing colors faster, varying colors, varying light output, and can even allow the capability of operating a color organ which pulses the lights to the beat of music. Prior art devices simply rotate a color wheel or index from one color to the next with limited flexibility. This invention also has the unique advantage of being able to synchronize with multiple light fixtures keeping all the colors the same for each light fixture and more importantly, from a safety standpoint, this invention will reset itself back to the brightest light color, white, upon start up. Other prior art lights, using antiquated color wheel technology, must either add special synchronizing options or the light is left in the same color as when it was turned off. A light has two purposes, one for aesthetics and the other safety. If someone or something falls into a pool or pond at night it is important to have a bright light on immediately. Only this light can provide this feature as a standard.

The instant invention includes the ability to be on 12 volt AC or higher electrical input and fully controlled with a simple wall switch or similar ON/OFF receptacle. Not only is it easy for the user, but it also allows easy retrofit capability to current installed lights.

Another key feature of this invention is the capability of making this light "smart" in that it can communicate via the microprocessor 18 with controllers outside of the fixture. Using state-of-the-art standard communication technology, the invention can provide information to the end user or service personnel such as "white light on", "red light on", "bulb is out", "light is set for 50% intensity", etc. A whole array of functions can be communicated to make this the first "smart" light on the market.

OPERATION OF THE INVENTION

Following is a summary of the operating features of the invention:

1. Fully programmable microprocessor 18 based electronic solid state system-no mechanical switches or relays;
2. Multiple bulbs, two or more with some possible combinations;
   a) Two bulbs-provides two colors or one color double the intensity,
   b) Three bulbs-provides three colors or two colors, one color can have double the intensity,
   c) Four bulbs-provides four colors or two colors with double the intensity,
   d) Five bulbs-provides either five colors or two colors (can have double the intensity),
   e) Six bulbs-provides either six colors or two colors can have double the intensity or five colors and one color has double the intensity,
   f) Seven bulbs-provides seven colors or three colors can have double the intensity and one additional color can be added or two colors can have double the intensity and two colors can be added or one color can have double the intensity and three colors can be added,
   g) Eight bulbs-provides either eight colors; or four colors can have double the intensity; or three colors can have double the intensity and one additional color can be added; or two colors can have double the intensity and two colors can be added; or one color can have double the intensity and three colors can be added.

More bulbs could be added, but current bulb technology does not allow this to occur due to the light intensity requirement, heat build up and size of the fixture.

Other prior art devices can provide up to four bulbs in the light fixtures but not five or more. In addition, prior art devices do not have the ability to vary the light intensity and color options as the instant invention does.

SUMMARY OF THE INVENTION

Following are some of the unique features of the instant invention:

a) Five bulbs or more in a fixture measuring less than nine inches in diameter. In a preferred embodiment, the lights 12 were industry standard MR16 Halogen sized bulbs or smaller.

a) Specially designed light mounting plate for maximum heat dispersion.

b) Capable of operating with either a 12 volt AC or 120 volt AC electrical input.

c) Ability to blend primary colors into a full spectrum of color.

d) Ability to provide light bulb thermal shock protection to extend bulb life.

e) Ability to operate unlimited lighting combination scripts.

f) Ability to operate unlimited lighting scripts with just one ON/OFF receptacle.

g) Ability to retrofit into most standard underwater light niches.

h) Ability to synchronize with other similar lights to keep all colors the same.

i) Ability to synchronize with other lights without the use of a separate wire.

j) Ability to operate using just three wire input.

k) Ability to reset one color for consistent operation and more importantly, safety.

l) Ability to dim different bulbs at different levels.

m) Ability to operate a color organ—pulse to the beat of music or similar stimuli.

n) Ability to be the first "smart" underwater light with full diagnostic capability, and communication capability to provide controllers or computers with all of the operating parameters of light.

o) Ability to switch selection of the program using the existing ON/OFF switch. A brief ON/OFF switch cycle allows selection of the next program. A longer ON/OFF switch cycle will cause the device to reset to the number one program. Continued brief ON/OFF cycles will select programs until rolling over to the number one program. The switch cycle program of the microprocessor 18 may be considered the electronic equivalent of a mechanical stepping switch as shown in FIG. 9.

p) The operation of the lights is truly independent, they can be made to sequentially change blend, illuminate separately, sequence uniformly, sequence non-uniformly, and sequence randomly.

q) The lights may be controlled remotely, by wire, IR, or radio link.

r) The lights may be reprogrammed remotely—in the field.

Thus it will be appreciated that the present invention provides a novel digital pool light which can be used with most swimming pools, SPAs or other underwater applications. It is contemplated that other embodiments and/or modifications may be made in the present invention without departure from the inventive concepts manifested by the disclosed embodiments. It is expressly intended, therefore, that the foregoing description is illustrative only of preferred embodiments, not limiting, and that the true spirit and scope of the invention be determined by reference to the appended claims.

What is claimed is:

1. A programmable, multi-colored, digital pool light system capable of operating multiple light sources and varying the power provided to each light bulb and thereby providing virtually unlimited amounts of light intensity, color blending and saturation, said light system comprising:

a housing shaped to fit an existing niche in an underwater application, said housing having an upper end and a lower end, a light bulb mounting plate having a plurality of light bulb retaining recesses, said mounting plate being mounted within said housing at said upper end, a plurality of high intensity light bulbs mounted in said light bulb retaining recesses, a plurality of light dispersing dichroic lenses mounted above selected light bulbs, a PC board having transistors, a programmable microprocessor means, a connector means for connecting said light bulbs to said microprocessor means, and a three wire power cord connected to an ON/OFF switch, said PC board being mounted in said lower end of said housing, and a sealing mechanism secured at said upper end of said housing, said sealing mechanism having a domed glass lens, and a rubber seal, said glass lens and rubber seal being securely fastened to said housing with a sealing clamp.

2. A programmable, multi-colored, digital pool light system of claim 1 wherein said programmable microprocessor means includes a process:

for blending different primary colors into a rainbow of color output, for providing an unlimited number of different lighting scripts, including changing colors, varying colors, varying light output, sequencing uniformly, non-uniformly and randomly, and for pulsing the lights to the beat of music, for synchronizing with multiple light fixtures keeping all the colors the same for each light fixture, for resetting the lights to the brightest light color, white, upon start up, for communicating with controllers outside of the fixture, for providing information to the end user including "white-light-on", "red-light-on" and, "bulb-is-out", for using the existing ON/OFF switch for selecting the programs, and for reprogramming remotely by wire, IR, and radio link.

* * * * *